US010690334B2

(12) United States Patent
Lin et al.

(10) Patent No.: US 10,690,334 B2
(45) Date of Patent: Jun. 23, 2020

(54) OPERATORY LIGHTS AND REPLACEMENT BULBS FOR OPERATORY LIGHTS

(71) Applicant: CAO Group, Inc., West Jordan, UT (US)

(72) Inventors: Zhaohui Lin, Salt Lake City, UT (US); Densen Cao, Sandy, UT (US)

(73) Assignee: CAO Group, LLC, South Jordan, UT (US)

( * ) Notice: Subject to any disclaimer, the term of this patent is extended or adjusted under 35 U.S.C. 154(b) by 0 days.

(21) Appl. No.: 15/052,268

(22) Filed: Feb. 24, 2016

(65) Prior Publication Data

US 2016/0245495 A1 Aug. 25, 2016

Related U.S. Application Data

(60) Provisional application No. 62/120,668, filed on Feb. 25, 2015.

(51) Int. Cl.

| | |
|---|---|
| ***F21V 29/76*** | (2015.01) |
| ***F21V 7/00*** | (2006.01) |
| ***F21K 9/23*** | (2016.01) |
| *F21W 131/205* | (2006.01) |
| *F21Y 115/10* | (2016.01) |

(52) U.S. Cl.

CPC ..... *F21V 29/767* (2015.01); *F21K 9/23* (2016.08); *F21V 7/0008* (2013.01); *F21W 2131/205* (2013.01); *F21Y 2115/10* (2016.08)

(58) Field of Classification Search

CPC ..... F21V 29/767; F21V 7/0008; F21K 9/23

See application file for complete search history.

(56) References Cited

U.S. PATENT DOCUMENTS

| | | | | |
|---|---|---|---|---|
| 7,111,969 | B2 * | 9/2006 | Bottesch | B60Q 1/0052 362/299 |
| 7,207,695 | B2 * | 4/2007 | Coushaine | F21K 9/00 362/240 |
| 2003/0016536 | A1 * | 1/2003 | Lin | F21S 9/022 362/249.02 |
| 2006/0098439 | A1 * | 5/2006 | Chen | F21L 4/027 362/294 |
| 2007/0102033 | A1 | 5/2007 | Petrocy | |
| 2008/0049438 | A1 * | 2/2008 | Bloemen | B60Q 1/0052 362/540 |
| 2008/0074885 | A1 * | 3/2008 | Brands | F21K 9/23 362/296.07 |
| 2009/0290349 | A1 | 11/2009 | Chu et al. | |
| 2010/0177515 | A1 * | 7/2010 | Shoushtari | F21V 19/045 362/249.02 |
| 2010/0203465 | A1 * | 8/2010 | Bria | F21V 7/0008 433/29 |

(Continued)

FOREIGN PATENT DOCUMENTS

| | | |
|---|---|---|
| JP | 2008108721 A | 5/2008 |
| JP | 2015-035372 | 2/2015 |
| WO | WO 2008/100277 A2 | 8/2008 |

*Primary Examiner* — Jong-Suk (James) Lee
*Assistant Examiner* — Christopher E Dunay

(57) ABSTRACT

An operatory light may comprise a bulb that includes a light emitting diode (LED) module positioned such that when the bulb is installed into a socket of the operatory light and powered, none of the light emitted from the LED is directed directly toward a lens of the operatory light, and only reflected light passes through the lens of the operatory light.

2 Claims, 13 Drawing Sheets

(56) References Cited

U.S. PATENT DOCUMENTS

| | | | | |
|---|---|---|---|---|
| 2010/0207534 | A1* | 8/2010 | Dowling | H05B 33/0818 315/186 |
| 2012/0327670 | A1 | 12/2012 | Pickard et al. | |
| 2013/0027947 | A1 | 1/2013 | Villard et al. | |
| 2013/0154465 | A1 | 6/2013 | Anderson | |
| 2014/0185288 | A1* | 7/2014 | Cunningham | F21K 9/50 362/235 |

* cited by examiner

OPERATORY LIGHTS AND REPLACEMENT BULBS FOR OPERATORY LIGHTS

CROSS-REFERENCES TO RELATED APPLICATIONS

This application claims the benefit of U.S. Provisional Application No. 62/120,668 filed on Feb. 25, 2015, which is hereby incorporated by reference in its entirety.

TECHNICAL FIELD OF THE INVENTION

The present invention relates to operatory lights and replacement bulbs for operatory lights. More specifically, an operatory light comprising a bulb that includes a light emitting diode (LED).

SUMMARY OF THE INVENTION

An operatory light may comprise a bulb that includes a light emitting diode (LED) positioned such that when the bulb is installed into a socket of the operatory light and powered, none of the light emitted from the LED is emitted directly through a lens of the operatory light; only reflected light passes through the lens of the operatory light.

A replacement bulb may comprise an LED positioned on a heat sink. The LED may be oriented to direct light toward a base of the replacement bulb and the base of the replacement bulb may be configured to couple with a socket of an operatory light.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific example embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings.

DETAILED DESCRIPTION

Figure 1:
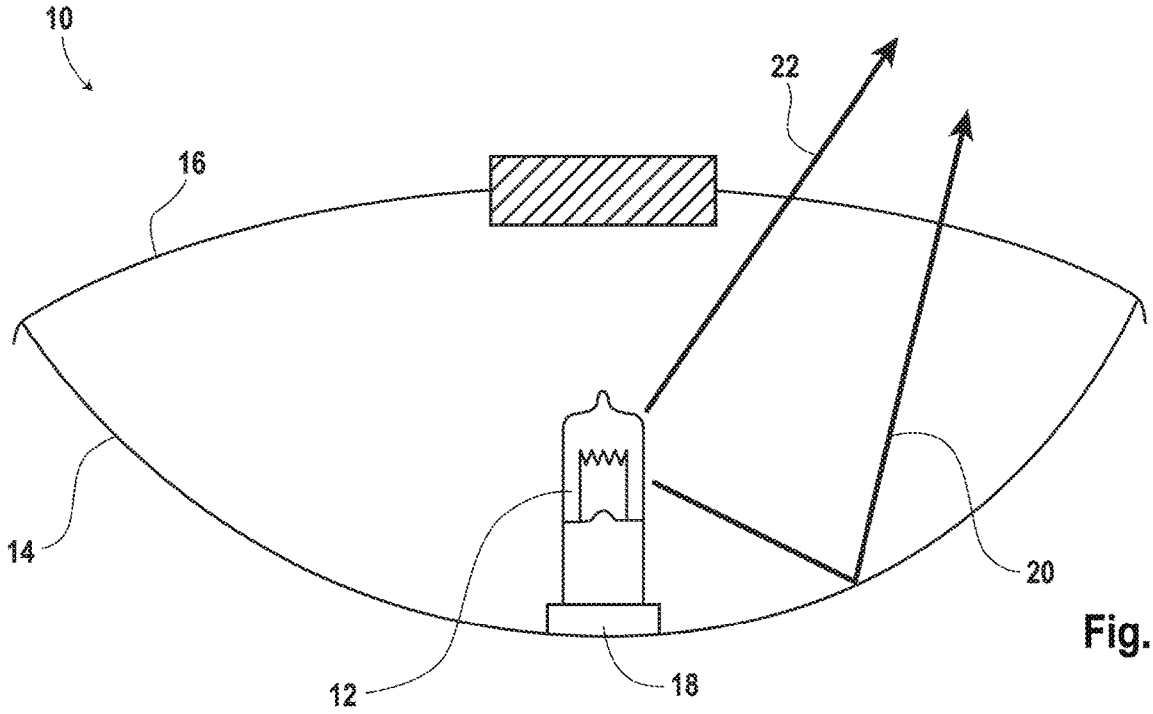
FIG. 1 shows a schematic view of an operatory light with a conventional bulb.

As shown in FIG. 1, an operatory light 10 may generally include a bulb 12, a reflector 14, and a lens 16. Traditional bulbs, such as bulb 12, may be incandescent bulbs that emit light in substantially all directions. When the bulb 12 is installed into a socket 18 of the operatory light 10 and powered, the bulb 12 may emit light directly toward the reflector 14, as illustrated by light beam 20. The bulb 12 also may emit light directly toward the lens 16, as illustrated by light beam 22.

Figure 2:
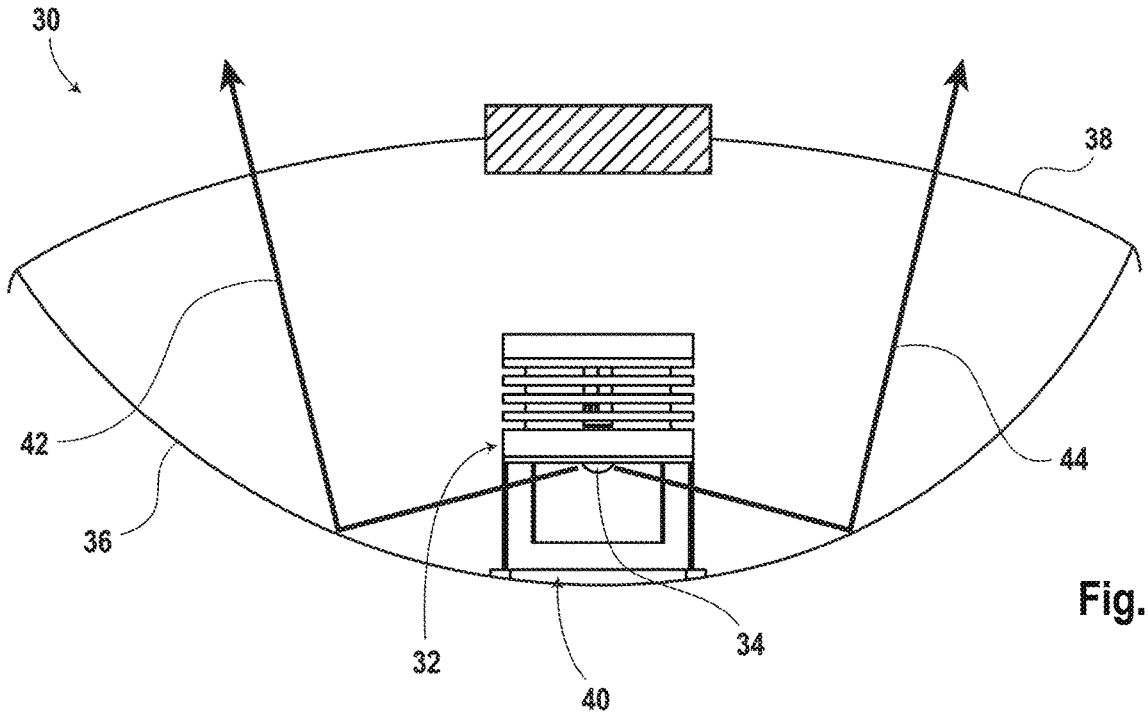
FIG. 2 shows a schematic view of an operatory light with a bulb according to an embodiment of the present invention.

In embodiments of the present invention, as shown in FIG. 2, an operatory light 30 may include a bulb 32 that includes a light emitting diode (LED) 34. The operatory light 30 (FIG. 1) may be identical to the operatory light 10 (FIG. 1), except that it includes a bulb 32 that is different than the traditional bulb 12. Referring again to FIG. 2, the operatory light 30 may include a reflector 36, a lens 38, and a socket 40. When the bulb 32 is installed into the socket 40 and powered, the LED 34 of the bulb 32 may emit light directly toward the reflector 36, as illustrated by light beams 42 and 44. None of the light from the LED 34, however, will be emitted directly toward the lens 38, and all of the light passing through the lens 38 will be reflected light. This is because the LED 34 is positioned so that it is directed toward the socket 40 and the reflector 36 of the operatory light 30 when the bulb 32 is installed in the socket 40.

Figure 3:
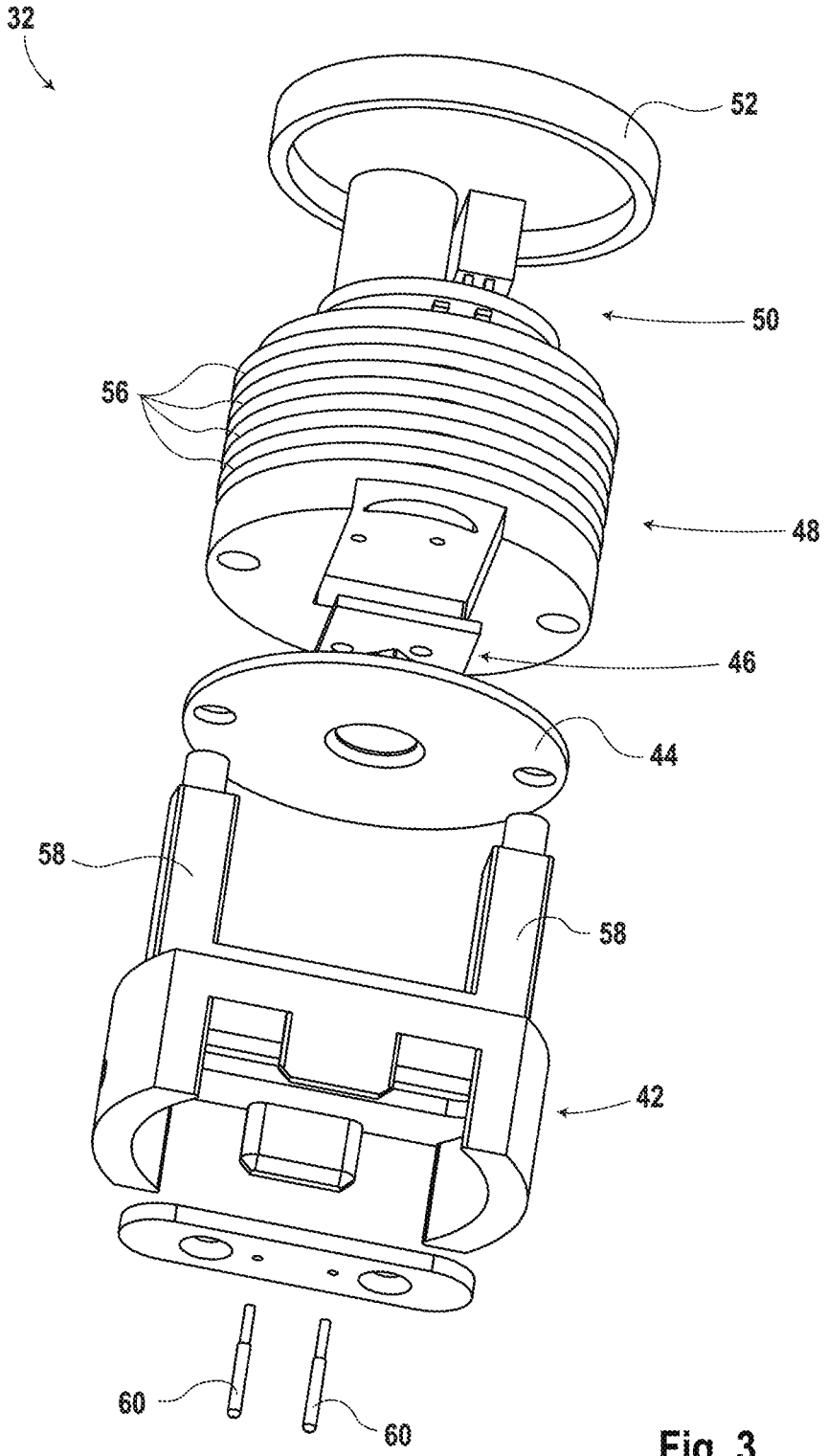
FIG. 3 shows an exploded view of the bulb of FIG. 2.

The bulb 32 will now be described in more detail with reference to FIGS. 3-5. FIG. 3 shows an exploded view of the bulb 32. As shown, the bulb 32 may include a base 42, a cover 44, an LED module 46, a heat sink 48, control circuitry 50, and a cap 52.

Figure 4:
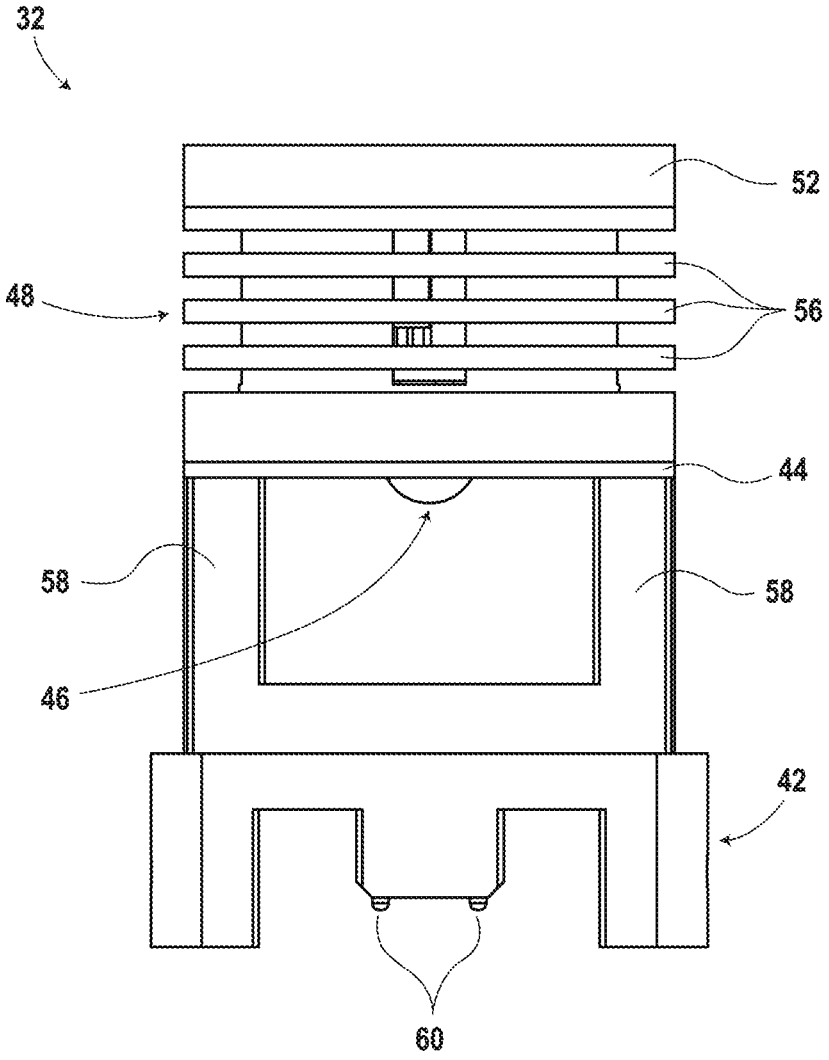
FIG. 4 shows a side view of the bulb of FIG. 2.
Figure 5:
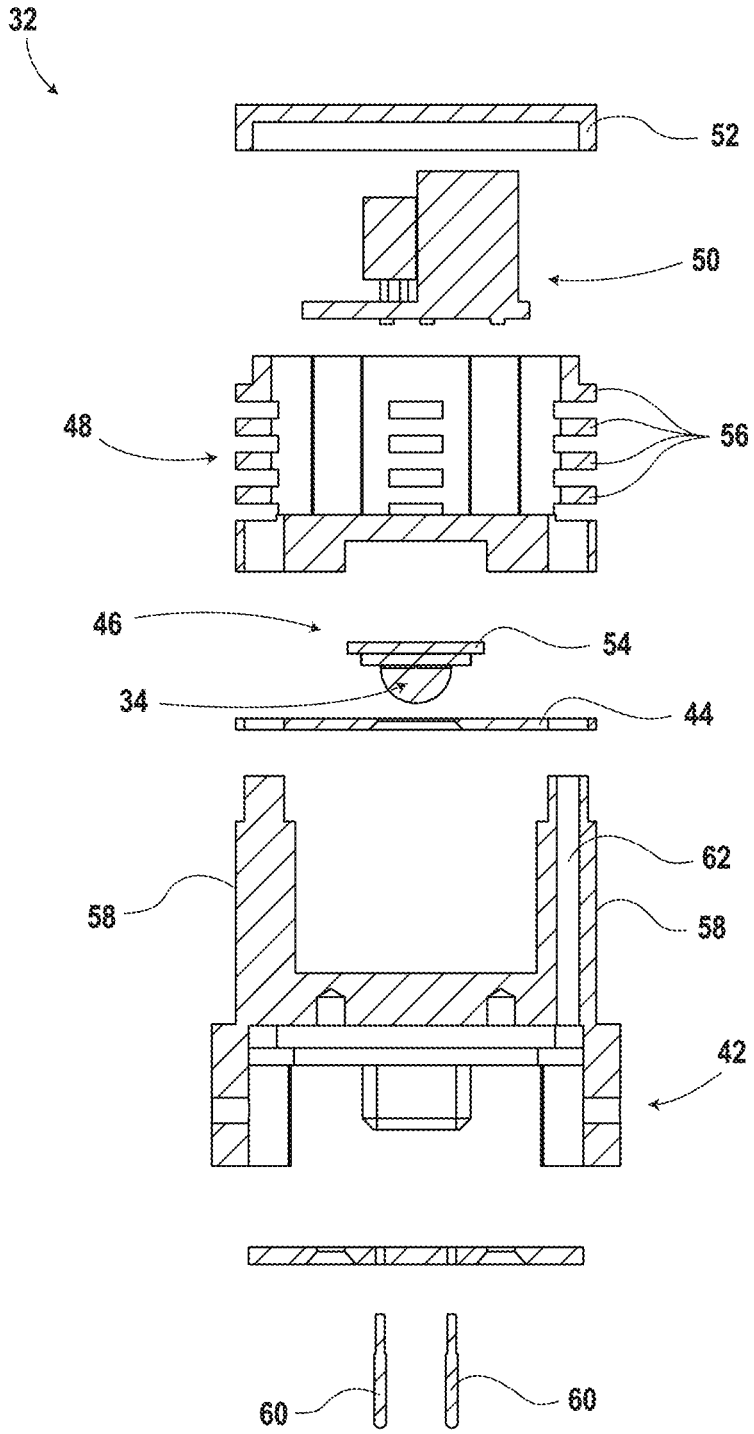
FIG. 5 shows an exploded cross-sectional view of the bulb of FIG. 2.

As shown in FIG. 4, the LED module 46 may include the LED 34, which may be a single packaged LED chip or a plurality of LED chips in a package, mounted on a heat conductive material, such as a metal printed circuit board (MPCB) 54. As shown, an encapsulant that covers LED chip(s) of the LED module 46 may serve as a lens.

The LED module 46 may be mounted to the heat sink 48 in a manner that facilities thermal conduction between the LED module 46 and the heat sink 48. For example, a thermally conductive adhesive may be utilized to attach the LED module 46 to the heat sink 48.

The control circuitry 50 may be located within a cavity of the heat sink 48 and the LED module may be electrically connected to the control circuitry 50 by wires (not shown) that may extend through apertures or conduits in the heat sink 48. The cap 52 may be attached to the heat sink 48 to enclose the control circuitry 50 therein.

Both the heat sink 48 and the cap 52 may be made from a heat conductive material, such as a metal or a thermally conductive polymer, and may serve to draw away and dissipate heat that may be generated by the LED 34 of the LED module 46. Additionally, the heat sink 48 and the cap 52 may draw away and dissipate heat that may be generated by the control circuitry 50. Additionally, the heat sink 48 may have features, such as fins 56, that may increase the surface area of the heat sink 48 and improve heat dissipation.

The cover 44 may be positioned on a surface of the heat sink 48 and may cover a portion of the LED module 46. An opening in the cover 44 may be positioned such that the LED 34 of the LED module 46 so that the LED 34 is not covered and light emitted from the LED 34 may pass through the cover 44.

The base 42 may be coupled to the cover 44 and/or the heat sink 48 by a plurality of legs 58 at a first end. The base 42 may include pins 60 at a second end thereof for electrical connection to the socket 40 of the operatory light 30. The pins 60 may be electrically coupled to the control circuitry 50 by wires (not shown) that may pass through a passage 62 (see FIG. 5) in one or more of the legs 58, and pass through one or more apertures in the cover 44 and heat sink 48.

Figure 6:
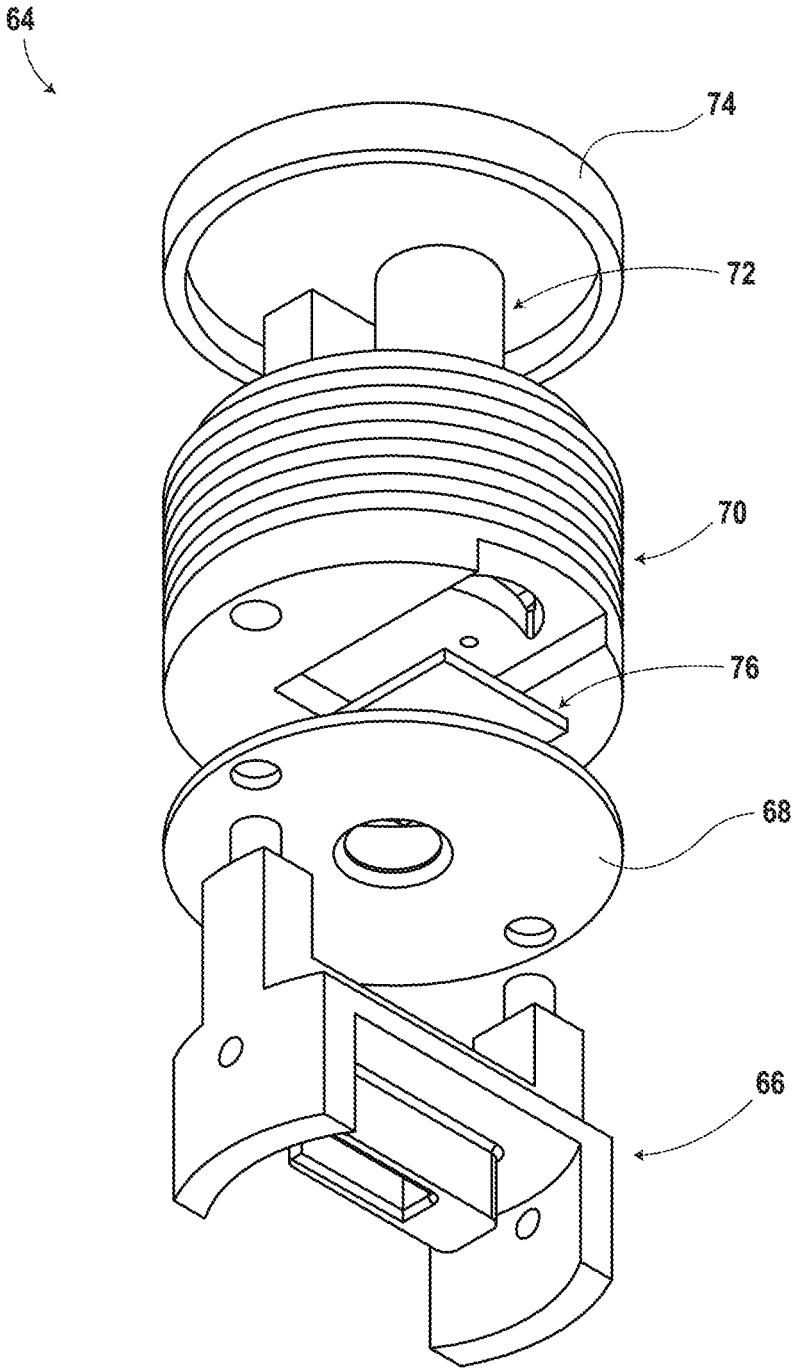
FIG. 6 shows an exploded view of another bulb according to an embodiment of the present invention.
Figure 7:
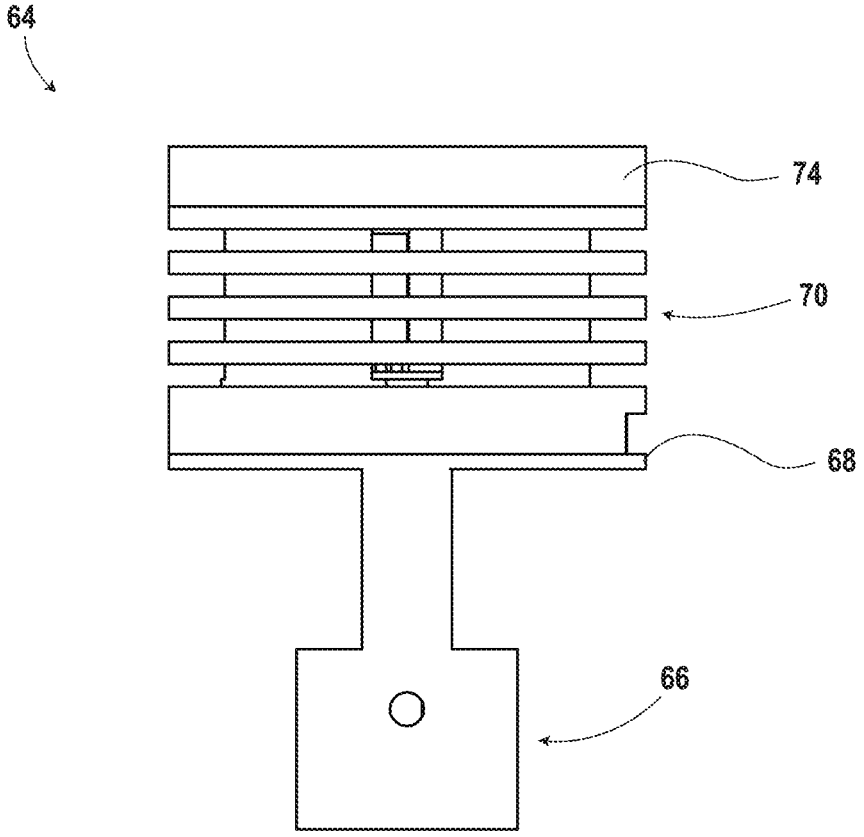
FIG. 7 shows a side view of the bulb of FIG. 6.
Figure 8:
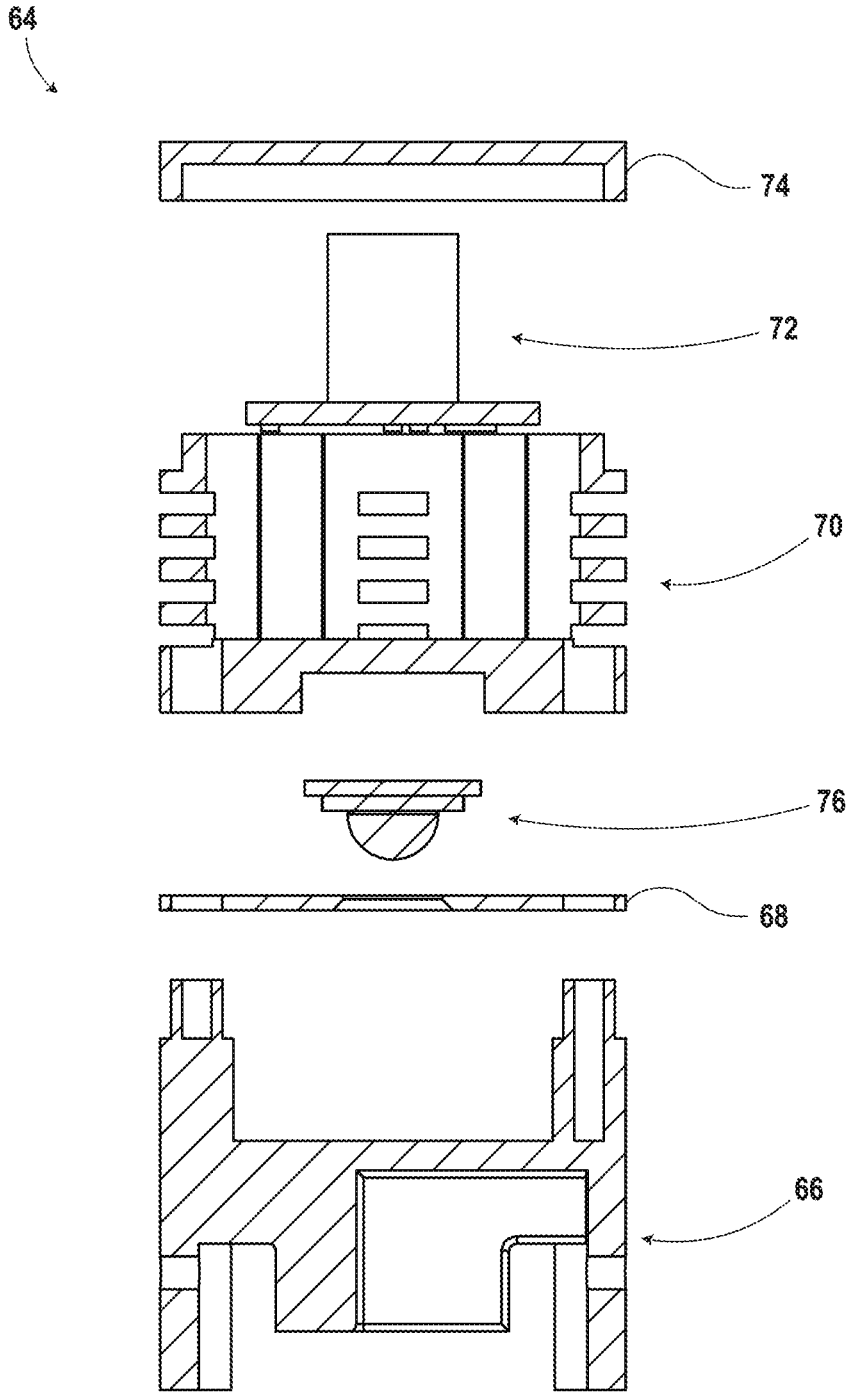
FIG. 8 shows an exploded cross-sectional view of the bulb of FIG. 6.

FIGS. 6-8 illustrate a bulb 64, according to another embodiment of the present invention. The bulb 64 may include an LED module 76, which may be substantially identical to the LED module 46 of the bulb 32. The bulb 64 may additionally include a base 66 that is configured to attach to a socket of another operatory light. The bulb 64 may similarly include a cover 68, a heat sink 70, control circuitry 72 and a cap 74.

Figure 9:
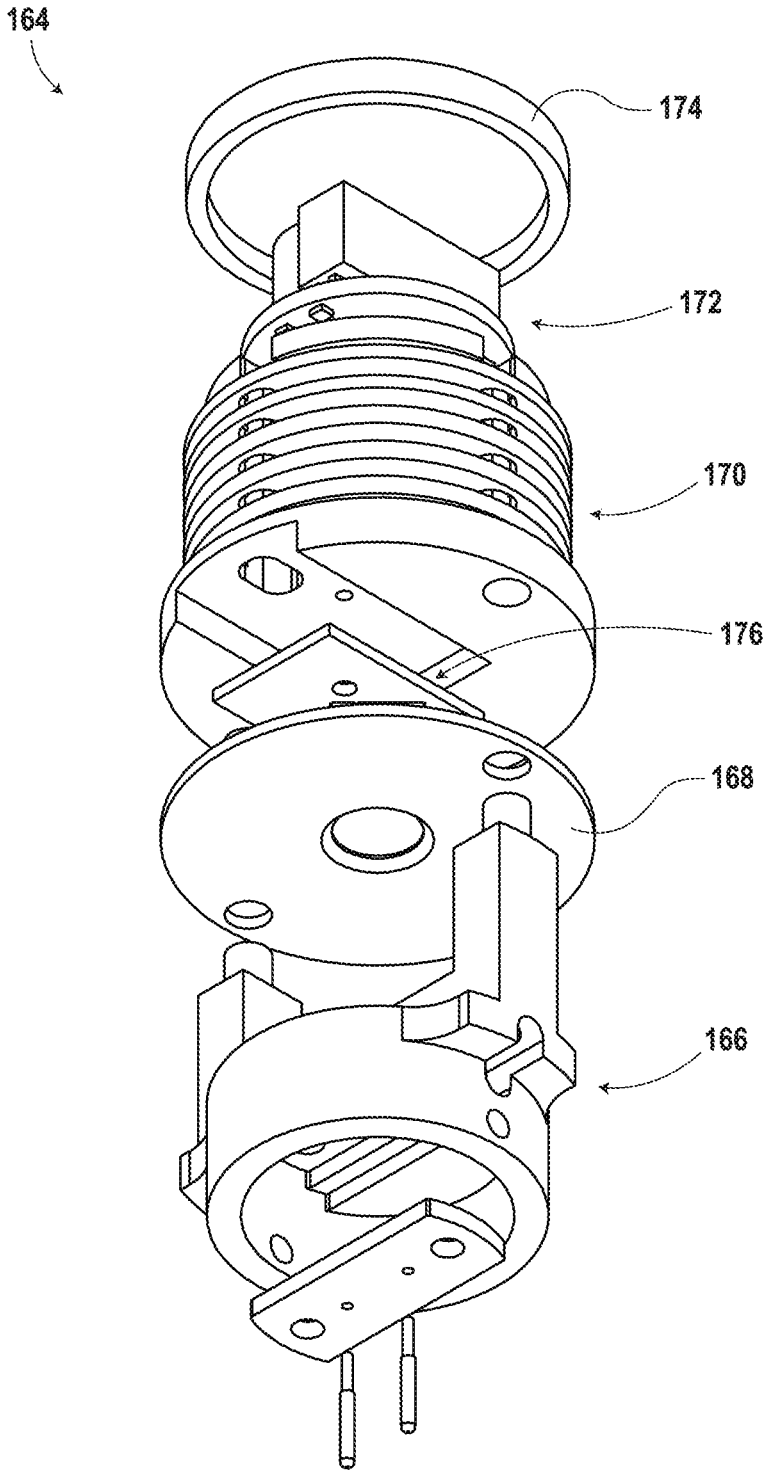
FIG. 9 shows an exploded view of another bulb according to an embodiment of the present invention.
Figure 10:
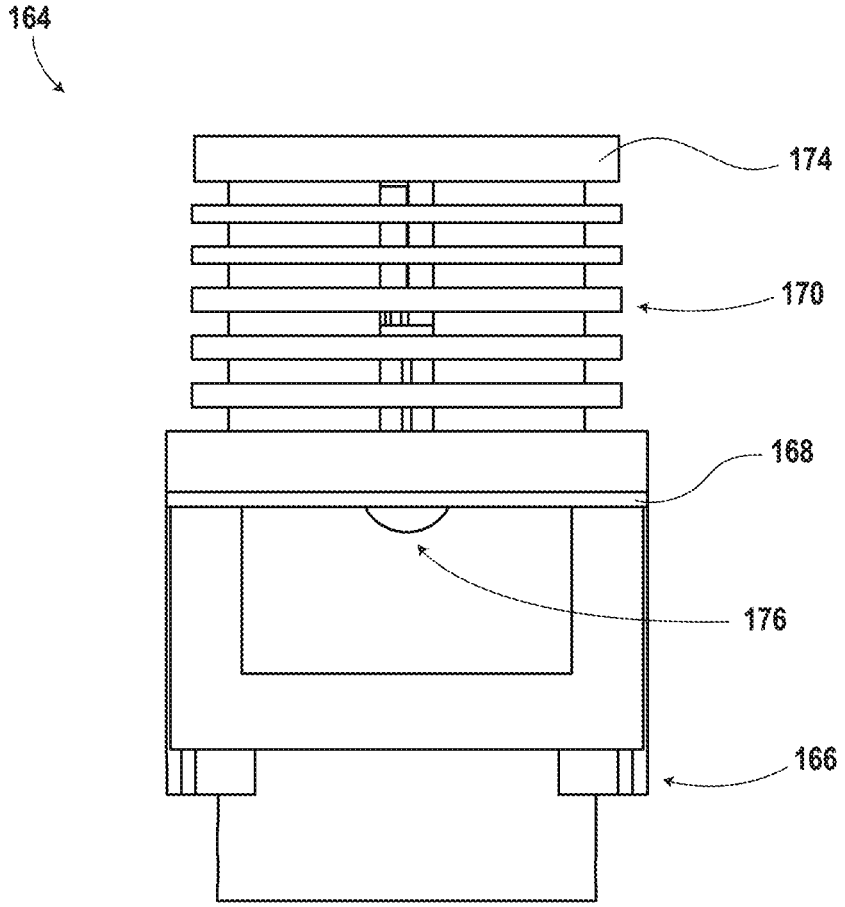
FIG. 10 shows a side view of the bulb of FIG. 9.
Figure 11:
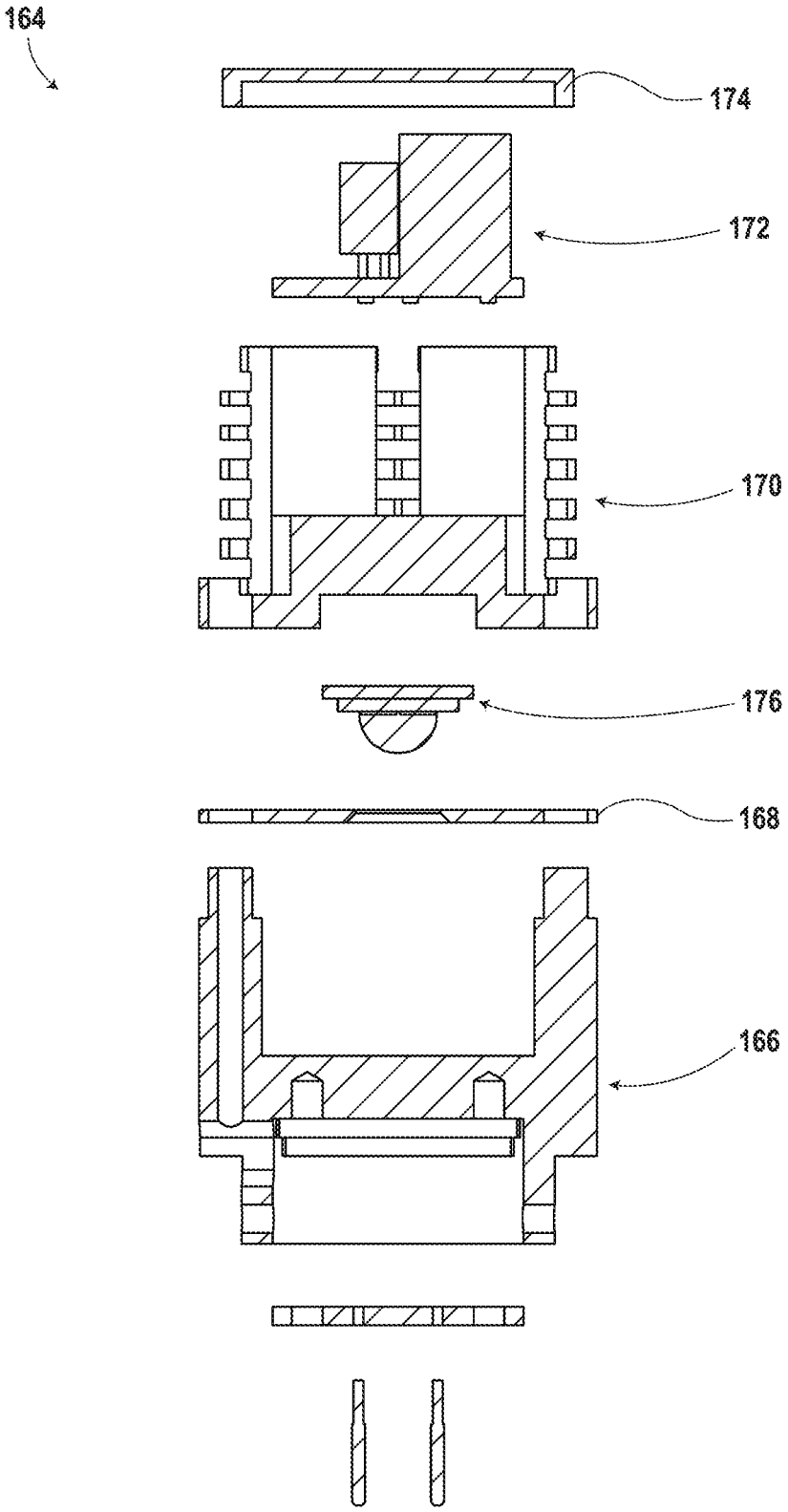
FIG. 11 shows an exploded cross-sectional view of the bulb of FIG. 9.

FIGS. 9-11 illustrate a bulb 164, according to another embodiment of the present invention. The bulb 164 may include an LED module 176, which may be substantially identical to the LED module 46 of the bulb 32. The bulb 164 may additionally include a base 166 that is configured to attach to a socket of another operatory light. The bulb 164 may similarly include a cover 168, a heat sink 170, control circuitry 172 and a cap 174.

Figure 12:
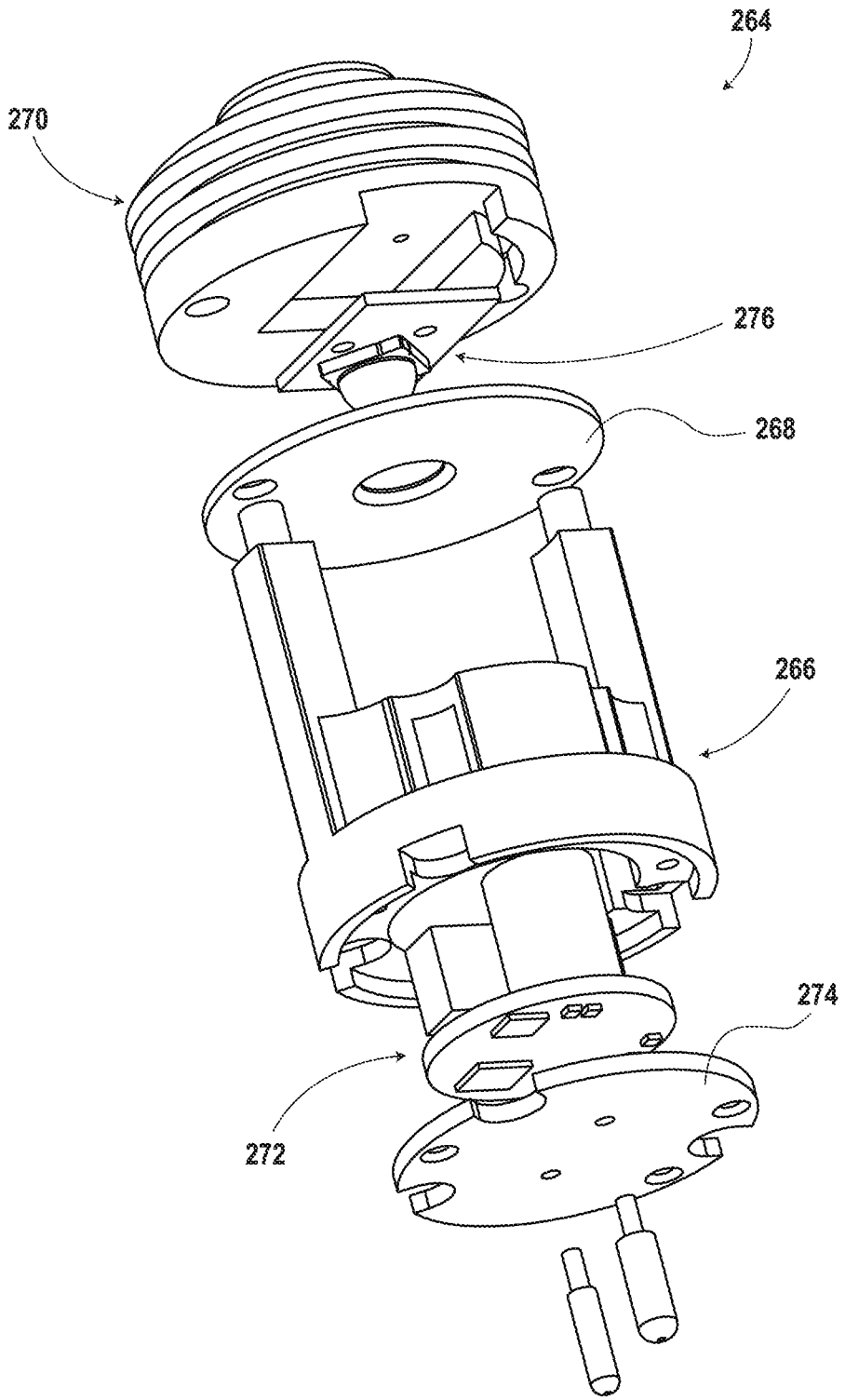
FIG. 12 shows an exploded view of another bulb according to an embodiment of the present invention.
Figure 13:
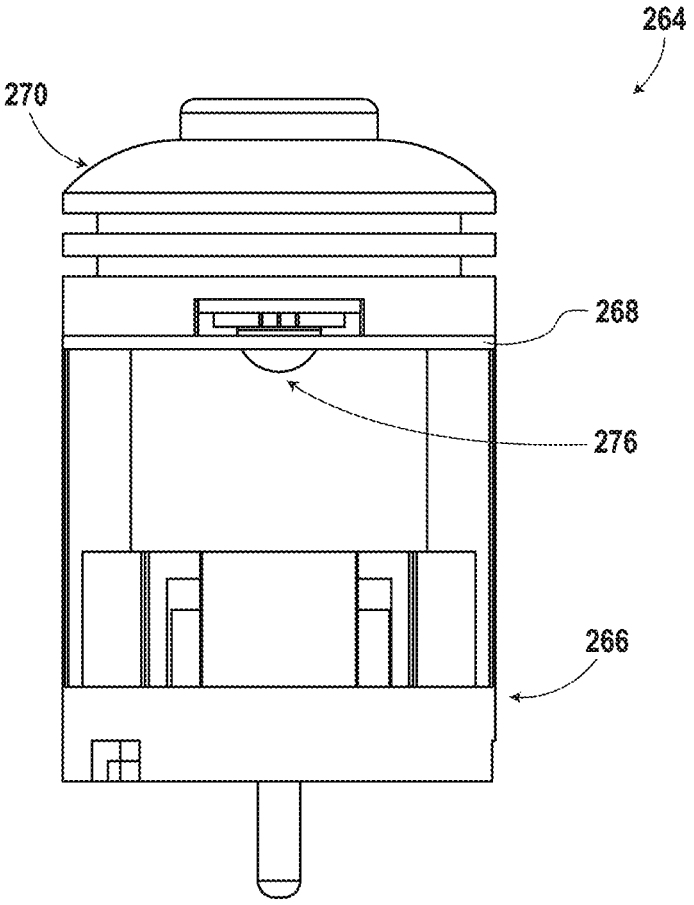
FIG. 13 shows a side view of the bulb of FIG. 12.
Figure 14:
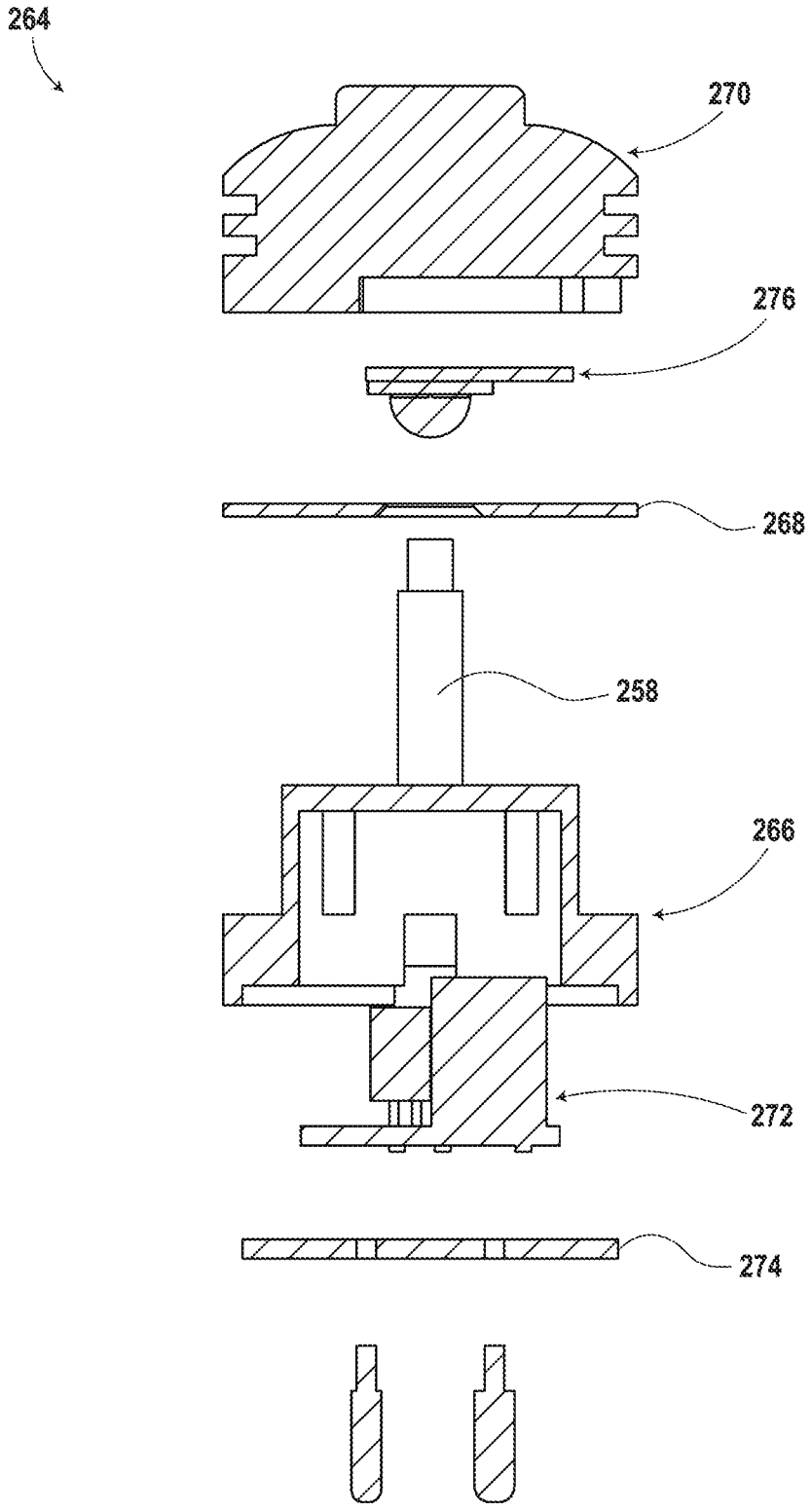
FIG. 14 shows an exploded cross-sectional view of the bulb of FIG. 12.

FIGS. 12-14 illustrate a bulb 264, according to another embodiment of the present invention. The bulb 264 may include an LED module 276, which may be substantially identical to the LED module 46 of the bulb 32. The bulb 264 may additionally include a base 266 that is configured to attach to a socket of another operatory light. The bulb 264 may also include a heat sink 270, control circuitry 272 and a cap 274. The bulb 264 may have a cavity in the base 266, rather than the heat sink 270, that contains the control circuitry. The cover 268 may attach to the base 266 to cover a cavity in the base 266. Accordingly, the control circuitry may be coupled to the LED module 276 by wires (not shown) that extend through one or more legs 258 of the base 266.

The present invention may be embodied in other specific forms. The described implementations are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An operatory light comprising:

a parabolic reflector with a socket located at a vertex;

a reflector lens covering the parabolic reflector, said lens and reflector defining an interior volume;

a light source attachable to the socket of the parabolic reflector, said light source further comprising:

a base having an interface with which to connect to the socket;

a plurality of legs extending from the base;

a cover plate having a plurality of apertures matching the plurality of legs and a central aperture;

a heat sink defining an internal well, and having a plurality of postholes matching the plurality of legs and plurality of apertures and a central hollow on a side of the heat sink opposite the internal well;

an LED module further comprising at least one LED chip, connection circuitry and a module lens;

control circuitry for the LED module, positioned in the internal well of the heat sink; and a cap, covering the internal well and the control circuitry;

wherein the plurality of legs is anchored in the plurality of postholes in the heat sink, passing through the plurality of apertures of the cover plate and the LED module is mounted in the hollow such that the module lens passes through the control plate and the LED module is then between the heat sink and the base, facing the base such that light emitted from the LED module passes through the windows and reflects off the reflector before passing through the reflector lens.

2. A light source for an operatory light, the light source comprising:

a base having an interface with which to connect to a socket in the operatory light;

a plurality of legs extending from the base;

a cover plate having a plurality of apertures matching the plurality of legs and a central aperture;

a heat sink defining an internal well, and having a plurality of postholes matching the plurality of legs and plurality of apertures and a central hollow on a side of the heat sink opposite the internal well;

an LED module further comprising at least one LED chip, connection circuitry and a module lens;

control circuitry for the LED module, positioned in the internal well of the heat sink; and a cap, covering the internal well and the control circuitry;

wherein the plurality of legs is anchored in the plurality of postholes in the heat sink, passing through the plurality of apertures of the cover plate and the LED module is mounted in the hollow such that the module lens passes through the control plate and the LED module is then between the heat sink and the base.

* * * * *